United States Patent [19]

Kollenz

[11] 4,294,690

[45] Oct. 13, 1981

[54] PROCESS FOR SEPARATING WEAKLY MAGNETIC ACCOMPANYING MINERALS FROM NONMAGNETIC USEFUL MINERALS

[75] Inventor: Erich Kollenz, Leoben, Austria

[73] Assignee: Voest-Alpine Aktiengesellschaft, Vienna, Austria

[21] Appl. No.: 136,708

[22] Filed: Apr. 2, 1980

[30] Foreign Application Priority Data

May 31, 1979 [AT] Austria ..... A3984/79

[51] Int. Cl.[3] ..... B03C 1/00

[52] U.S. Cl. ..... 209/3; 209/39; 209/214; 241/24

[58] Field of Search ..... 209/3, 39, 213, 214, 209/216; 241/24, 79

[56] References Cited

U.S. PATENT DOCUMENTS 4,191,336 3/1980 Brown ..... 241/24 X

OTHER PUBLICATIONS

Li et al., *Tungsten,* ACS Monograph No. 94, 3rd ed., Reinhold Pub. Corp., NY, NY, 1955.

*Primary Examiner*—Ralph J. Hill

*Attorney, Agent, or Firm*—Cushman, Darby & Cushman

[57] ABSTRACT

The invention relates to a process for separating accompanying minerals which are weakly magnetic from useful minerals or ores which are nonmagnetic or less magnetic than the accompanying minerals that are to be separated therefrom, and it is its objective to make magnetic pre-separation of such weakly magnetic accompanying minerals feasible. This is achieved in accordance with the invention in that the ore is crushed to a grain size of 0.2 mm at most, and is separated in a magnetic separator operating with a strong magnetic field, if desired after removal of the strongly magnetic fragments of grinding bodies by means of a magnetic separator operating with a weak magnetic field, and prior to separation by flotation, which may also be applied if desired.

6 Claims, 1 Drawing Figure

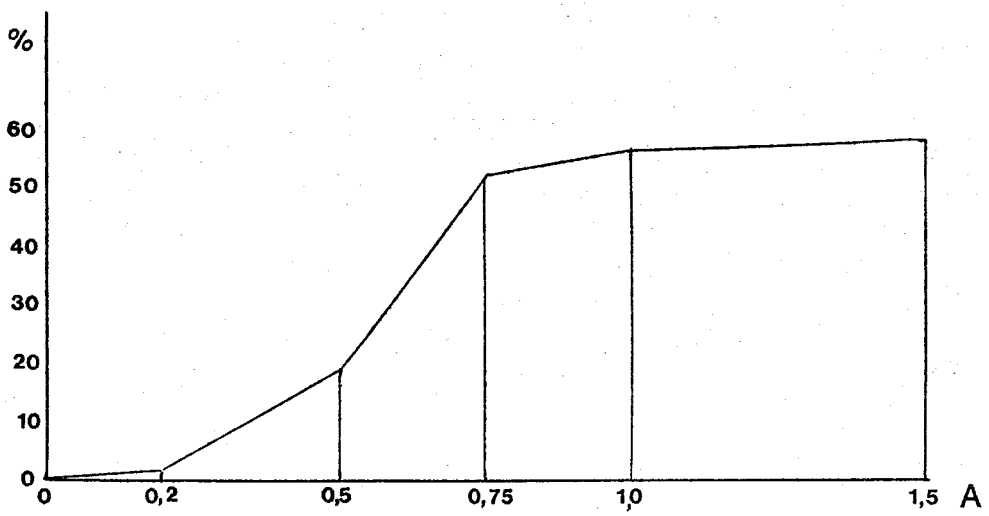
%
60
50
40
30
20
10
0
0
0,2
0,5
0,75
1,0
1,5
A

PROCESS FOR SEPARATING WEAKLY MAGNETIC ACCOMPANYING MINERALS FROM NONMAGNETIC USEFUL MINERALS

The invention relates to a process for separating accompanying minerals which are weakly magnetic, in particular paramagnetic, having a mass susceptibility (susceptibility divided by the density of a material) of below $200.10^{-6}$ $cm^3/g$, from useful minerals or ores, respectively, which are nonmagnetic or less magnetic than the accompanying minerals that are to be separated therefrom, in particular for separating chlorites from scheelite. As a rule, plural step processes are used for the purpose of such upgrading or preliminary upgrading. Gravimetric methods are for instance employed, which sort out useful minerals and part of the undesired minerals in jigs or dressing tables by making use of their different densities prior to employing flotation methods for the finest fractions, which will yield a concentrate of the desired mineral. Gravimetric preliminary grading methods usually are only applicable at grain sizes of more than 0.2 mm, since their effectiveness will be too low at grain sizes below said magnitude.

A magnetic separation of weakly magnetic accompanying minerals used to be deemed infeasible in the case of paramagnetic minerals having a mass susceptibility of $\chi<200.10^{-6}$ $cm^3/g$. A statement to that effect is to be found in e.g. Schubert, Aufbereitung fester mineralischer Rohstoffe (Upgrading of Solid Mineral Raw Materials), Vol. II, p. 155. such weakly magnetic minerals comprise e.g. the chlorites, which have a mass susceptibility of $\chi=100.10^{-6}$ $cm^3/g$, as well as talcum, monazite, hornblende, pyroxenes and certain micas.

It is the object of the instant invention to make such weakly magnetic accompanying minerals accessible to magnetic pre-separation. In order to attain this objective the process of the invention essentially is characterized in that the ore is crushed to a grain size of 0.2 mm at the most, and is separated in a magnetic separator operating with a strong magnetic field, if desired after removal of the strongly magnetic fragments of grinding bodies by means of a magnetic separator operating with a weak magnetic field, and prior to separation by flotation, which may also be applied if desired. When crushing the ore to a grain size of 0.2 mm at the most it has surprisingly appeared that minerals having a very low mass susceptibility, as e.g. the chlorites already mentioned, can be readily sorted out of weaker magnetic minerals or nonmagnetic minerals by means of a separator operating with a strong field. To explain this surprising effect it is assumed that because of the crushing of the material the well-known pronounced inhomogeneity in density, which in the case of chlorites may be between 2.6 to 3.3 $g/cm^3$, will no longer be operative to an extent that would prevent separation. Mass susceptibility depends on the magnetic moment of certain ions as well as on the concentration of same. This particularly applies to bivalent and trivalent Fe and to manganese. The consequence thereof is that a marked change will occur in the mass susceptibility already when there is a small change in the concentration of these elements, as is frequent in mixed crystals. In the case of the mentioned chlorites predominantly so-called mixed crystals are concerned, which may comprise Fe-concentrations of different intensity. The fluctuations primarily are the result of different Fe-concentrations, which also cause great fluctuations in mass susceptibility, which permit the separation of such weakly magnetic minerals after crushing as previously were considered inseparable. The inventive pre-separation by means of separators operating with a strong magnetic field furthermore is of economical advantage since part of the flotation reagents will become unnecessary and the yield will be improved while at the same time the concentration can be increased if a flotation is subsequently carried out. When proceeding in accordance with previously known treatment methods flotation always would have to cope with these undesired minerals, too, which can be removed by the magnetic separation of the invention. It therefore would have been necessary to employ reagents which force down these accompanying minerals in the flotation in order to prevent their rising to the surface in the course of the flotation. On the surface the useful mineral is to be found in the flotation stage, and can be drawn off continuously. Reagents of the mentioned kind may also force down part of the useful mineral together with certain undesirable accompanying minerals. On the other hand it may of course happen that accompanying minerals which have the respective hydrophobic properties will float up to the surface together with the useful mineral. In either case recovery of the useful mineral from the flotation will thus be negatively influenced and disturbing accompanying minerals, as far as they interfere in the further treatment of the mineral, can only be removed in the course of smelting by fluxing and purification methods. The magnetic separation of the invention after grinding of the ore to a grain size of at the most 0.2 mm therefore brings about a significant increase in the capacity of the flotation performed subsequently, increasing the yield in useful mineral and at the same time increasing the concentration.

It will be particularly advantageous to employ the inventive magnetic separation in a separator operating with a strong magnetic field if flux densities are in the range of from 350 to 800 mT, preferably from 400 to 700 mT, where the unit mT is milli Teslas. The most advantageous flux density values vary according to the strong-field separator used, but experience has shown that also with different strong-field separators the weakly magnetic disturbing accompanying minerals can be separated optimally within a flux density range of from 400 to 700 mT. A further increase in the flux densities does not result in an increase in total yield.

After removal of the weakly magnetic minerals there remain, when treating scheelite, merely nonmagnetic minerals, e.g. quartz, which can be separated in the flotation without difficulty.

The invention is explained in the following in greater detail by way of a diagram shown in the drawing. On the abscissa of this diagram the energizing current has been indicated in amperes and on the ordinate the total yield in chlorites obtained from scheelite has been indicated in percent. It can be learned from this diagram that at an energizing current of 0.75 A, which according to the type of equipment used corresponds to a flux density of 400 to 700 mT, approximately 52% of the chlorites were separated. An increase in the current density to 1.0 A resulted in a total yield of more than 55%. By increasing the field intensity a total yield of about 58% was obtained, which it was not possible to further improve by further increasing the exciting current intensity and thus the field intensity.

The strong-field separator may be introduced at any point in the flow chart of the treatment process after crushing of the ore and before flotation. Strong-field separators consist of a magnet system of opposed poles. The magnetic field forms between a pole piece of flat surface and a pole piece having a convex or pointed shape (e.g. presenting one or more edges). In contrast thereto, weak-field separators consist of a bipolar or multipolar magnet system wherein the pole pieces are arranged either in a plane or on a cylindrical surface. The magnetic field is a stray field in that case. According to the invention preferably magnetic field separators which are operated in wet condition are used, wherein any possible agglomerations of finest grain are again divided by being subjected to a water jet within the range of the magnetic field.

What is claimed is:

1. A process for separating minerals having a mass susceptibility of below $200\times10^{-6}$ $cm^3/g$ from useful minerals or ores which are nonmagnetic or less magnetic than the minerals to be separated therefrom comprising the steps of:

crushing said minerals or ores to a grain size no greater than 0.2 mm; and separating said minerals in a magnetic separator having a strong magnetic field.

2. The process of claim 1 wherein the magnetic field of said magnetic separator is in the range of 350 mT to 800 mT.

3. The process of claim 1 wherein the magnetic field of said magnetic separator is in the range of 400 mT to 700 mT.

4. The process of claim 1, 2 or 3 wherein said magnetic separator is operated in the wet condition.

5. The process of claim 1, 2 or 3 further comprising the step of initially separating strongly magnetic minerals by a magnetic separator operating under a weak magnetic field.

6. The process of claim 5 further comprising the step of separating said minerals by flotation after said strong field separating step.

* * * * *